US007731393B2

(12) United States Patent
Kirsten

(10) Patent No.: US 7,731,393 B2
(45) Date of Patent: Jun. 8, 2010

(54) LIGHT FIXTURE FOR PRODUCING AN OBLONG LUMINOUS SURFACE

(75) Inventor: Martin Kirsten, Burscheid (DE)

(73) Assignee: **BA*RO GmbH & Co. KG**, Leichlingen (DE)

( * ) Notice: Subject to any disclaimer, the term of this patent is extended or adjusted under 35 U.S.C. 154(b) by 0 days.

(21) Appl. No.: 11/892,551

(22) Filed: Aug. 23, 2007

(65) Prior Publication Data

US 2008/0068843 A1 Mar. 20, 2008

(30) Foreign Application Priority Data

Aug. 24, 2006 (DE) ..... 20 2006 013 006 U
Apr. 18, 2007 (DE) ..... 20 2007 005 692 U

(51) Int. Cl.
*F21V 7/00* (2006.01)

(52) U.S. Cl. ..... 362/294; 362/261; 362/263; 362/296.01

(58) Field of Classification Search ..... 362/261, 362/263, 296, 296.01, 297
See application file for complete search history.

(56) References Cited

U.S. PATENT DOCUMENTS 2,259,321 A 10/1941 Pahl
4,379,322 A 4/1983 Kelly

FOREIGN PATENT DOCUMENTS

DE 4323422 1/1995
DE 4323422 A1 * 1/1995

* cited by examiner

*Primary Examiner*—Anabel M Ton
(74) *Attorney, Agent, or Firm*—Berenato & White, LLC

(57) ABSTRACT

The invention relates to a light fixture for producing an oblong luminous surface with a horizontal illuminant and a box reflector which has a curved reflector surface and planar reflector surfaces to the side enclosing the curved reflector surface, the horizontal illuminant being disposed at right angles to the planar reflector surfaces to the side, which is characterized in that the curved reflector surface is designed to produce the oblong luminous surface at right angles to the horizontal illuminant, and the planar reflector surfaces to the side are designed to sharply define the longitudinal sides of the oblong luminous surface.

2 Claims, 3 Drawing Sheets

LIGHT FIXTURE FOR PRODUCING AN OBLONG LUMINOUS SURFACE

CROSS-REFERENCE TO RELATED APPLICATIONS AND CLAIM TO PRIORITY

This application is related to utility model application number 20 2006 013 006.6, filed Aug. 24, 2006, in the Federal Republic of Germany, the disclosure of which is incorporated herein by reference and to which priority is claimed.

FIELD OF THE INVENTION

The invention relates to a light fixture for producing an oblong luminous surface with a horizontal illuminant and a box reflector which has a curved reflector surface and planar reflector surfaces to the side enclosing the curved reflector surface, the horizontal illuminant being disposed at right angles to the planar reflector surfaces to the side.

BACKGROUND OF THE INVENTION

Goods display surfaces, such as for example refrigerated display cases, fruit displays, sales shelves etc. are generally lit artificially. The aim here is to light these as evenly as possible, and this is only possible to a certain extent due to the generally elongated rectangular form of these sales units, or requires a plurality of light fixtures.

In DE 298 12 344 U1 a light fixture is described for producing an oblong luminous surface which has a horizontal illuminant and a box reflector. The box reflector has a curved reflector surface and planar reflector surfaces to the side enclosing these. The horizontal illuminant is disposed at right angles to the planar reflector surfaces to the side. During operation the light fixture produces an oblong luminous surface which is disposed longitudinally in relation to the horizontal illuminant and the length of which is substantially determined by that of the horizontal illuminant.

A disadvantage of this light fixture is that when it is positioned a large distance away from the goods display surfaces, the effectiveness of the useful lighting can become limited.

SUMMARY OF THE INVENTION

It is therefore an objective of this invention to design a light fixture of the type specified at the start such that oblong goods display surfaces, which in particular are spaced more than 3.5 m away from the light fixture, can be lit evenly locally, high useful lighting effectiveness being achieved.

This objective is fulfilled according to the invention with a light fixture of the type specified at the start in that the curved reflector surface is designed to produce the oblong luminous surface at right angles to the horizontal illuminant, and the planar reflector surfaces to the side are designed to sharply define the longitudinal sides of the oblong luminous surface.

The basic thinking behind the invention therefore is that a reflection space is formed by a curved reflector surface, which can for example be ellipsoidal or parabolic in form, and planar surfaces to the side enclosing these. The curved reflector surface reflects the light radiated by the horizontal illuminant such that the oblong luminous surface is produced at right angles to the horizontal illuminant, the planar reflector surfaces to the side ensuring that the oblong luminous surface is sharply defined on its longitudinal sides.

An advantage of the light fixture according to the invention is that with its help, oblong goods display surfaces can also be lit evenly from a height of more than 3.5 m, high useful lighting effectiveness being achieved.

According to one embodiment of the invention, provision is made such that recesses are provided in the planar reflector surfaces to the side which are enclosed by further planar reflector surfaces. The recesses can in particular be rectangular in form and be disposed at right angles to the extension of the curved reflector surface. In this case the box reflector has an overall cruciform light outlet opening on its lower side. One advantage here is that an even higher level of reflection of the radiation emitted by the illuminant can be achieved, by means of which the useful lighting effectiveness can be further increased.

It is also possible to use a high pressure gas discharge lamp as the horizontal illuminant.

BRIEF DESCRIPTION OF THE FIGURES

In the following the invention is described in greater detail by means of an example of an embodiment with reference to the drawings. The figures show as follows.

DETAILED DESCRIPTION OF THE PREFERRED EMBODIMENT(S)

Figure 1:
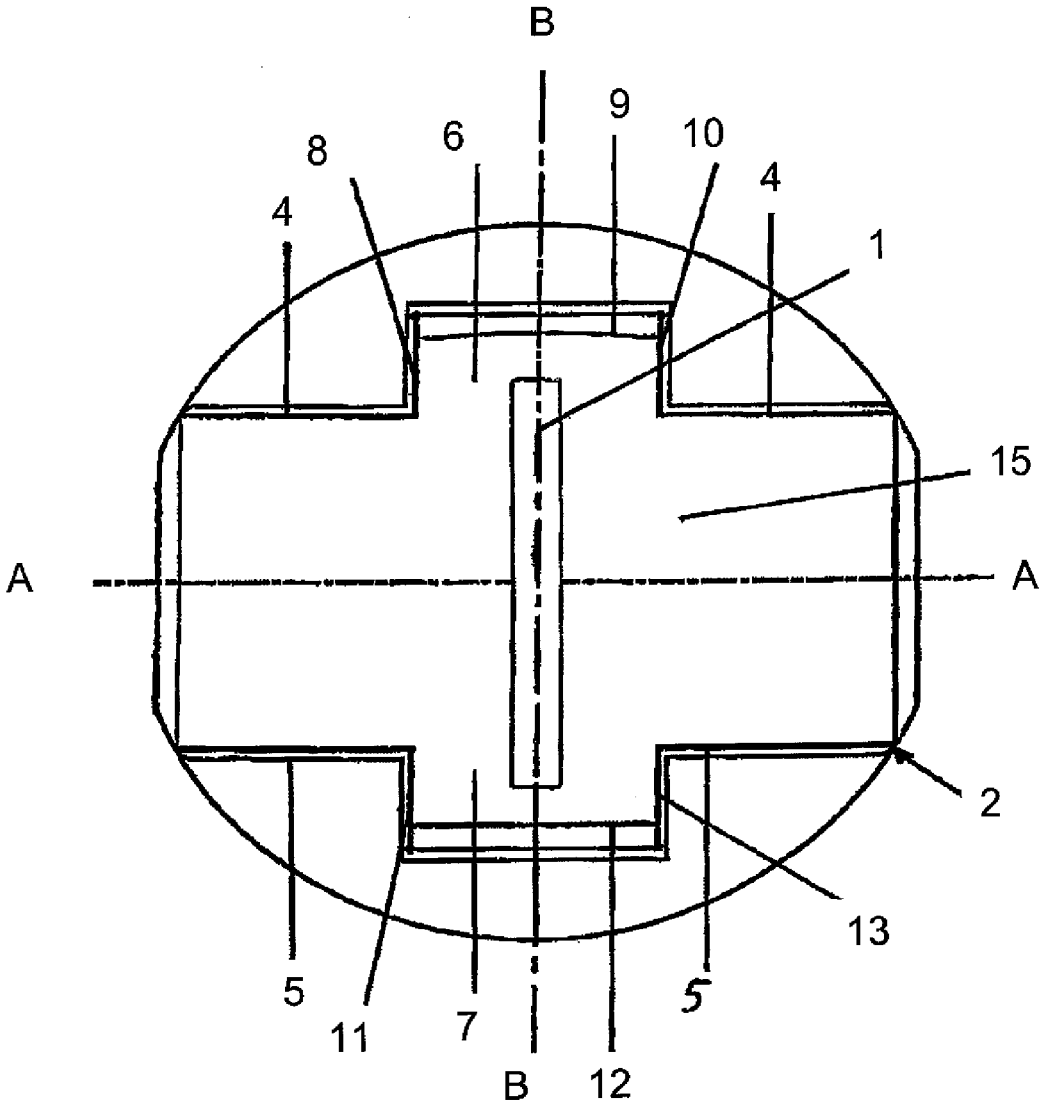
FIG. 1 is a top view of a light fixture according to the invention.
Figure 2:
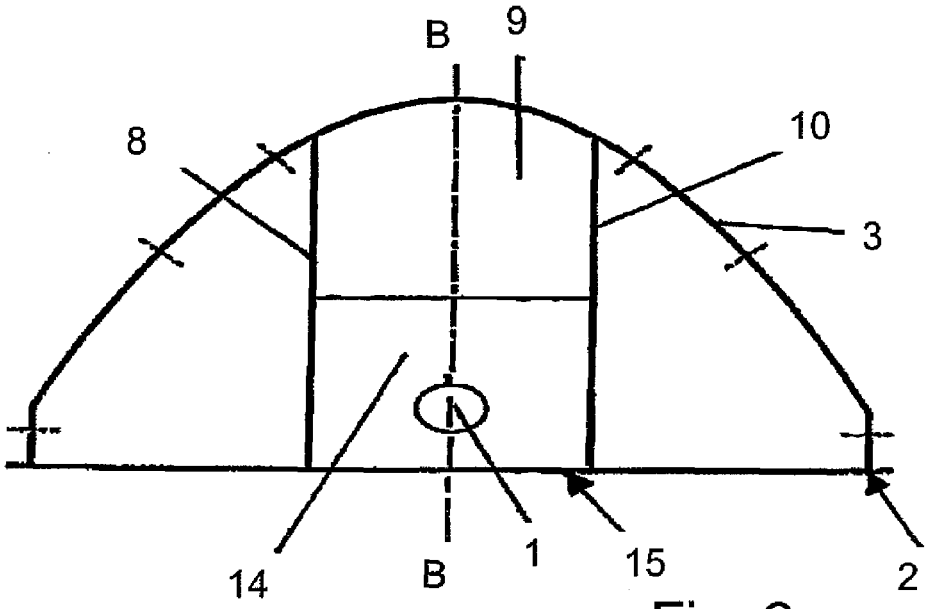
FIG. 2 is a cross-section through the light fixture according to FIG. 1 along line A-A.
Figure 3:
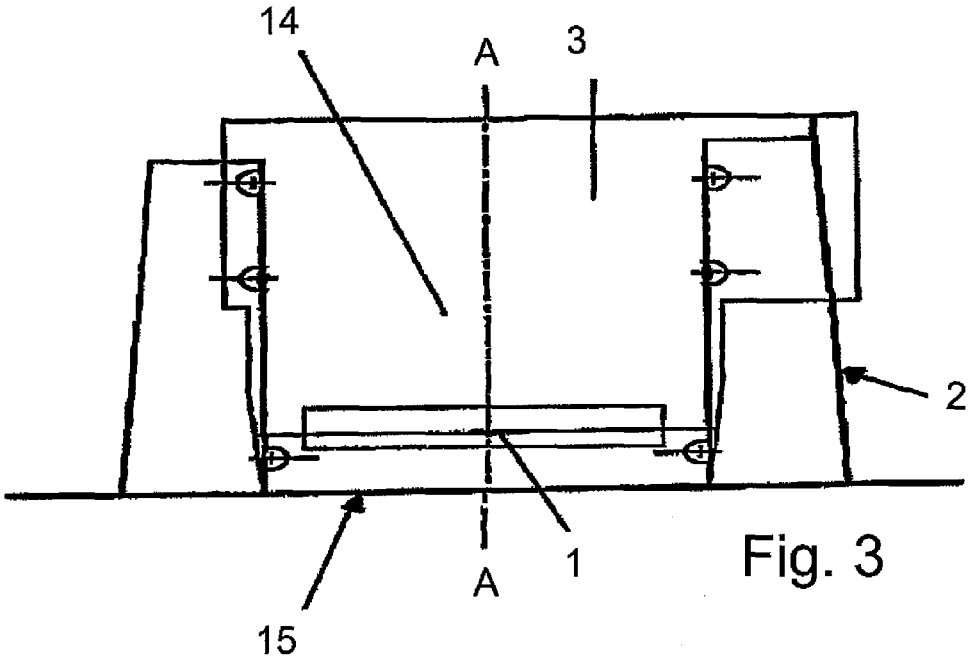
FIG. 3 is a longitudinal section through the light fixture according to FIG. 1 along line B-B.

FIGS. 1 to 3 show a light fixture according to the invention. The light fixture has a horizontal illuminant 1 and a box reflector 2. The horizontal illuminant 1 is in the form of a high pressure gas discharge lamp here.

The box reflector 2 comprises a curved reflector surface 3 which is parabolic in form here, and planar reflector surfaces 4, 5 to the side which enclose the curved reflector surface 3. In each of the planar reflector surfaces 4, 5 to the side a rectangular recess 6, 7 is formed which is enclosed by further planar reflector surfaces 8, 9, 10, 11, 12, 13. The reflector surfaces 3, 4, 5, 6, 7, 8, 9, 10, 11, 12, 13 taken as a whole form a reflection space 14 which surrounds the horizontal illuminant 1 and which has a cruciform light outlet opening 15 on the lower side.

The box reflector 2 can be made totally or partially of metal with a light-reflecting surface.

During operation of the light fixture, part of the radiation produced by the horizontal illuminant 1 is emitted directly through the light outlet opening 15 towards the oblong luminous surface which is produced. Here, the longitudinal sides of the oblong luminous surface are sharply defined by the arrangement of the reflector surfaces 4, 5, 8, 9, 10, 11, 12, 13.

A further part of the radiation produced is reflected by the reflector surfaces 3, 4, 5, 6, 7, 8, 9, 10, 11, 12, 13 of the reflection space 14 towards the oblong luminous surface, by means of which high useful lighting effectiveness is achieved. The reflection surfaces 4, 5, 6, 7, 8, 9, 10, 11, 12, 13 limit the outlet of the scattered radiation here such that the oblong luminous surface produced is sharply defined on its longitudinal sides. Considered overall, the oblong luminous surface is aligned at right angles to the horizontal illuminant 1.

Figure 4:
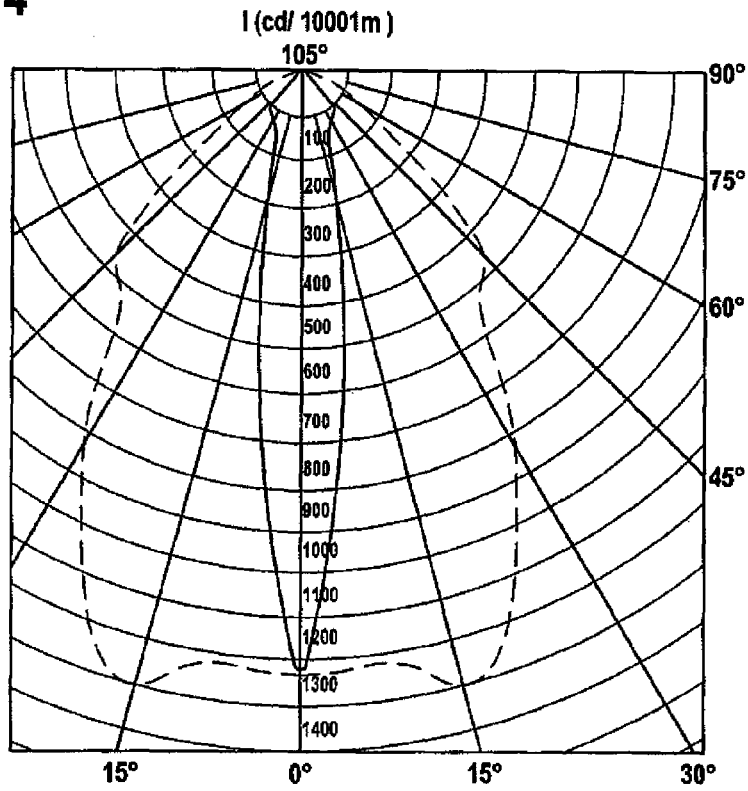
FIG. 4 is a light distribution chart of the light fixture according to FIG. 1.
Figure 5:
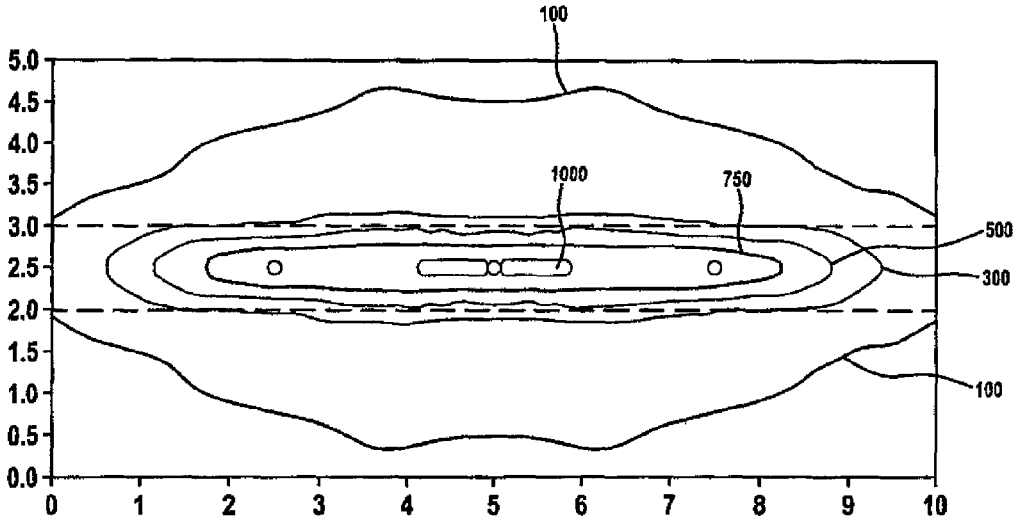
FIG. 5 is a light planning chart with which three light fixtures according to the invention are arranged a distance apart from one another.

FIG. 4 shows the light distribution chart of the light fixture of FIGS. 1-3. FIG. 5 illustrates light planning chart for three light fixtures according to the invention which are positioned a distance of 2.5 m apart from one another. The distance between the light fixtures and the oblong goods display to be lit here is 4 m. One can clearly see the oblong sharply defined luminous surface of the light fixture.

I claim:

1. A light fixture for producing an oblong luminous surface comprising:

a horizontal illuminant;

a box reflector having a curved reflector surface;

first and second planar reflector surfaces disposed to the side of the curved reflector surface;

at least one planar reflector surface connected to said first planar surface to define a first side recess; and at least one planar reflector surface connected to said second planar surface to define a second side recess, wherein the horizontal illuminant is disposed at right angles to the first and second planar reflector surfaces, the placement of the curved reflector and the planar reflector surfaces with respect to the horizontal illuminant forming an oblong luminous surface, the curved reflector surface produces an oblong luminous surface at right angles to the horizontal illuminant, and the first and second planar reflector surfaces to the side sharply define the longitudinal sides of the oblong luminous surface.

2. The light fixture according to claim 1, wherein the horizontal illuminant is a high pressure gas discharge lamp.

* * * * *